US007497158B2

(12) United States Patent
Daniel et al.

(10) Patent No.: US 7,497,158 B2
(45) Date of Patent: Mar. 3, 2009

(54) BALING MACHINE WITH NARROW HEAD WIRE FEEDER

(75) Inventors: Bart Daniel, Kennesaw, GA (US); Timothy Stamps, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 1372 days.

(21) Appl. No.: 09/919,247

(22) Filed: Jul. 31, 2001

(65) Prior Publication Data

US 2003/0024404 A1 Feb. 6, 2003

(51) Int. Cl.
*B65B 13/04* (2006.01)

(52) U.S. Cl. ..... 100/26; 100/3

(58) Field of Classification Search ..... 100/3, 100/25, 26, 29, 32, 8; 53/529, 589
See application file for complete search history.

(56) References Cited

U.S. PATENT DOCUMENTS

| | | | | | |
|---|---|---|---|---|---|
| 2,632,381 | A | | 3/1953 | Buckland | 100/7 |
| 2,780,986 | A | | 2/1957 | Ritenour | 100/25 |
| 3,070,001 | A | | 12/1962 | Feldkamp | 100/25 |
| 3,213,780 | A | * | 10/1965 | Neitzel et al. | 100/4 |
| 3,470,813 | A | | 10/1969 | Nomm et al. | 100/4 |
| 3,521,550 | A | * | 7/1970 | Van Doorn et al. | 100/26 |
| 3,568,591 | A | | 3/1971 | Dunlap | 100/4 |
| 3,621,888 | A | | 11/1971 | Ericsson | 140/93.2 |
| 3,720,158 | A | * | 3/1973 | Sauer et al. | 100/4 |
| 3,834,297 | A | | 9/1974 | Huson | 100/3 |
| 3,863,558 | A | | 2/1975 | Trumbo | 100/33 |
| 3,910,089 | A | | 10/1975 | Meier et al. | 72/146 |
| 3,916,778 | A | * | 11/1975 | Van Doorn et al. | 100/4 |
| 3,921,799 | A | | 11/1975 | Meier | 206/83.5 |
| 3,935,616 | A | | 2/1976 | Simmons | 24/20 |
| 4,031,594 | A | | 6/1977 | Cepuritis | 24/20 |
| 4,048,697 | A | | 9/1977 | Duenser | 24/20 |
| 4,062,086 | A | | 12/1977 | Wojcik | 24/20 |
| 4,079,667 | A | | 3/1978 | Lems et al. | 100/2 |
| 4,080,689 | A | | 3/1978 | Meier | 24/20 |
| 4,090,440 | A | | 5/1978 | Jensen | 100/4 |
| 4,156,385 | A | | 5/1979 | Lems et al. | 100/3 |
| 4,158,994 | A | | 6/1979 | Jensen | 100/3 |
| 4,226,007 | A | | 10/1980 | Duenser | 24/20 |
| 4,228,565 | A | | 10/1980 | Lems et al. | 24/20 |
| 4,378,262 | A | | 3/1983 | Annis, Jr. | 156/73.5 |
| 4,391,186 | A | | 7/1983 | Davis | 100/7 |

(Continued)

OTHER PUBLICATIONS

Videotape; Cranston Wire Tying; approximate date 1985; approximate length 4 minutes.

*Primary Examiner*—Shelley Self
(74) *Attorney, Agent, or Firm*—Conley Rose, P.C.; Kristin Jordan Harkins

(57) ABSTRACT

A bulk material baler for binding bales of bulk material with more than two baling wires or straps. The baling wires or straps are bound around the bale with wire drive wheels that push the wire through a guide track around the bale and back to a knotter that ties together the ends of the bale wire. The narrow head of the present invention orients the drive wheels in a plane perpendicular to the plane of the bale wire loop, and makes it possible to put the wire feed drive wheels, knotter and guide track ends all in a 9¼ inches wide space so that adjacent baling wires can be bound around a bale simultaneously.

24 Claims, 11 Drawing Sheets

U.S. PATENT DOCUMENTS

| | | | | | |
|---|---|---|---|---|---|
| 4,403,542 | A | | 9/1983 | Lewis | 100/2 |
| 4,450,763 | A | | 5/1984 | Saylor | 100/31 |
| 4,466,535 | A | | 8/1984 | Huson | 206/83.5 |
| 4,484,518 | A | | 11/1984 | Jaenson | 100/4 |
| 4,501,356 | A | | 2/1985 | Urban et al. | 206/83.5 |
| 4,520,720 | A | | 6/1985 | Urban et al. | 100/26 |
| 4,534,817 | A | | 8/1985 | O'Sullivan | 156/352 |
| 4,566,378 | A | * | 1/1986 | Fleissner | 100/26 |
| 4,584,935 | A | | 4/1986 | Luggen | 100/26 |
| 4,611,534 | A | | 9/1986 | Kudlicka et al. | 100/26 |
| 4,625,635 | A | | 12/1986 | Lewis | 100/26 |
| 4,649,812 | A | | 3/1987 | Mouret | 100/5 |
| 4,665,815 | A | | 5/1987 | Fleissner | 100/2 |
| 4,787,425 | A | | 11/1988 | Saylor | 140/73 |
| 4,951,562 | A | | 8/1990 | Ribaldo | 100/8 |
| 5,039,250 | A | | 8/1991 | Janz | 405/15 |
| 5,070,779 | A | | 12/1991 | Molitorisz | 100/31 |
| 5,117,536 | A | | 6/1992 | Beach et al. | 24/20 |
| 5,133,532 | A | | 7/1992 | Figiel et al. | 254/216 |
| 5,379,687 | A | | 1/1995 | Moseley | 100/3 |
| 5,417,320 | A | | 5/1995 | Velan et al. | 206/83.5 |
| 5,477,724 | A | | 12/1995 | Velan et al. | 72/385 |
| 5,483,837 | A | | 1/1996 | Velan et al. | 73/805 |
| 5,546,855 | A | | 8/1996 | Van Doorn et al. | 100/11 |
| 5,644,978 | A | | 7/1997 | Jaenson et al. | 100/8 |
| 5,673,614 | A | | 10/1997 | Jaenson et al. | 100/8 |
| 5,689,934 | A | | 11/1997 | Scherer et al. | 53/399 |
| 5,746,120 | A | | 5/1998 | Jonsson | 100/4 |
| 5,826,499 | A | | 10/1998 | Bullington | 100/3 |
| 5,870,950 | A | | 2/1999 | Wiedel | 100/33 |

* cited by examiner

BALING MACHINE WITH NARROW HEAD WIRE FEEDER

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention relates generally to a bale-binding machine that uses a narrow head wire feeder for looping and fastening wire around a bale of bulk material such as cotton.

2. Related Art

Wire baling of bulk materials benefits from increased speed and reduced materials cost through automation. Bulk materials include fibrous bulk materials such as cotton and nylon. Fibrous materials are commonly formed into bales by simultaneous compression and binding. There is a continuing need in the automated baling art to improve the efficiency, reliability and accuracy of the bale binding process.

Baling wire performance requirements vary depending upon the bulk material being baled. Such requirements range from industry standard specifications to general operational parameters, such as minimum speeds required for profitability. The Cotton Council issues standards specifying particular lengths of wire around various sizes of bales and the tension that the wires must withstand. These standards vary for different bale configurations such as a "standard density," bale or "universal density" bale. The most common bale configuration is "standard density," which is 20×54 inches in size, for which Cotton Council Industry Standards require six baling wires which are 9¼ inches apart from one another.

Current automated baling machines use an articulated track to guide wire around bales of bulk material, such as cotton, while that bale is under compression. Part of the wire guide track in current automated balers must be removable to a second position after the ends of the baling wire have been tied together, in order to allow ejection of the bale and insertion into the baler of the next unit of material for baling. Material to be baled is typically introduced into the automatic baler under vertical compression. Typical pressures for an industry standard 500 pound, 20×54 inch cotton bale are in excess of 300 tons. Horizontal plates called follower blocks apply compression through platens which contact the surface of the cotton or other material being compressed. The Platens incorporate slots which run lateral to the longitudinal axis of the bale. There are six slots in the platens. These slots allow the baling wire to be wrapped around the bale while it is still under compression. Under the lateral slots are lateral channels for insertion of the wire guide tracks in both the upper and lower platens in automatic balers.

Automatic baling machines use power drives to propel the wire around the bulk material to be baled through the wire guide tracks. Typical wire propulsion speeds are about ten feet per second. This propulsion is conventionally imparted to the baling wire by means of drive wheels. Prior art automatic balers powered the drive wheels hydraulically. Prior art automatic balers have been able to align six or even eight assemblies of wire feeders, guide tracks and knotters abreast, see U.S. Pat. No. 4,450,763 patent column 8, lines 61-64. Also see U.S. Pat. No. 5,379,687, to Moseley disclosing six wire feed/guide track assemblies abreast, see column 4, lines 61-62. However, these were driven with a single drive shaft rotated by a chain connected to an hydraulic motor, column 7, line 66 through column 8, line 7.

Hydraulic drive created leakage problems. Hydraulic leaks are highly consequential in fibrous bulk material baling because cotton or nylon stained with hydraulic fluid is unmarketable. Leaks of hydraulic fluid onto components that come in contact with the cotton will stain not only the first bale, but subsequent bales of fibrous material as well. Lost time for repair of hydraulic leaks is problematic because baling operations such as cotton gins are subject to time constraints due to the seasonal nature of cotton harvesting and because unattended bulk cotton waiting for baling can be ruined by fermentation if not baled and distributed in a timely fashion. A potential solution to such problems is powering the drive wheels with electric motors. Feeding wire and/or twisting knots with electric motors is known in the prior art, see U.S. Pat. No. 4,450,763 to Saylor, column 9, lines 36-38 and column 10, lines 41-44.

Automatic baling machines using either simple electric motors or hydraulic drive operated with a certain degree of inefficiency. In order to loop baling wire around bulk material to be baled, then release the wire from a guide track and finally knot the ends of the wire, tension had to be generated on the wire during baling. Likewise, in order to properly knot the ends of the wire, tension had to be maintained in the twisting procedure that generates the knot. These tensions must be maintained within prescribed ranges to optimize efficiency and to produce a final bale that complies with industry standards. Certain knotting speeds must be avoided because too much speed in the twisting procedure produces brittleness, metal fatigue and weak knots, see U.S. Pat. No. 4,450,763, Column 1, lines 59-65. Weak knots fail industry standards. Too much tension in the overall wire loop can generate weaknesses or wear-points in the baling wire, or can generate wear in the wire guide tracks or other parts of the automatic baling machine. Automatic baling machines would benefit from more precise control of such variables. Further, if the position of the leading and trailing ends of the wire were precisely controlled, costs could be reduced by using less wire. If precise control guaranteed compliance with industry strength standards, less costly gauges of wire could be used. Electric and hydraulic drive systems required large margins of error for tension, position, torques and speeds in order to ensure compliance with industry standards and to avoid breakdowns. Large margins of error in turn require heavier gauges of wire, which are more expensive. Electro servo motors increase precision in these areas, and thereby narrow acceptable margins of error.

In analogous baling operations, such as baling hay, the recognition of the advantages of more precise control has lead to the use of electric servo motors, capable of outputting data which may be used for precise control of position, torque and speed. U.S. Pat. No. 5,746,120 to Jonsson illustrates the use of electric servo motors in balers. However, bulky electric servo motors have only been used in the prior art in configurations having only one wire loop, see U.S. Pat. No. 5,746,120.

Prior art automatic baling machines oriented drive wheels on the same plane as the bale wire loop around the bale. See, U.S. Pat. No. 5,746,120 at column 2, line 67, FIG. 3; U.S. Pat. No. 4,450,763, Column 7, line 50, 65 and Column 8, line 9; U.S. Pat. No. 5,379,687, Column 8, line 4-6. This configuration necessitates that the drive wheel axis and the driving electric servo motor be oriented perpendicular to the plane of the bale wire loop. Such an orientation is problematic in that the drive wheel/drive servo motor assembly would occupy more than the 9¼ inch wide space which is the Industry Standard for bale wire loop spacing. Accordingly, prior art automatic bale machines were not capable of aligning six sets of electro-servo motors, drive wheels and wire guide tracks in parallel within the 9¼ inch industry standard space limitations. Consequently, looping and tying all six bale wires simultaneously was impossible.

Prior art automatic balers addressed this issue by configuring three or fewer sets of electro-servo motors, drive wheels and bale wire guide tracks in parallel. The present applicant has mounted three on a carriage that would tie a first set of three bale wires 18 and ½ inches apart at a first position, and then the carriage would translate down a boom to a second position 9¼ inches offset from the first position and repeat the bale wire loop and tie procedure for the second set of three bale wire loops interspersed between the first three loops.

Typical execution times for the two-step prior art procedure include double the looping and tying time which, in addition to the translation time, yields a total baling time for each bale of 16 to 20 seconds. If six wires could be looped and tied simultaneously, execution times for one step baling would be four to five seconds.

There is a need in the art to minimize execution time for looping and tying six bale wires, while maintaining operational reliability and efficiency, and improving precision and efficiency.

SUMMARY OF THE INVENTION

It is in view of the above problems that the present invention was developed. The invention is a narrow head configuration for a baling wire feed system incorporating wire feed drive wheels oriented in a plane perpendicular to the plane of the baling wire loop. The wire feed drive wheels are propelled by an electric servo motor. The longitudinal axis of the servo motor and its drive shaft are parallel to the plane of the bale wire loop. The present invention eliminates hydraulic leak problems with the use of electric servo motors. The present invention allows for all necessary components to be configured within a 9¼ inch wide wire feed head, including the wire feed drive wheels, wire feed drive wheel servo propulsion motor, wire tying head, cutter and tensioning grip. Accordingly, a wire feed head width dimension of 9¼ inches, being consistent with the industry standard spacing between bale wire loops for fibrous bulk material bales, allows an apparatus design with six bale wire loop heads abreast while still using electro-servo motor drive. This in turn allows all six baling wires to be looped, knotted and cut simultaneously, affording a great increase in speed of baling operations without sacrificing electro-servo motor precision. Both three head and six head embodiments increase precision and decrease maintenance expense. The six head embodiment with all six bale wire loops being executable simultaneously, decreases cycle time.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate representative embodiments of the present invention and, together with the description, serve to explain the principles of the invention. In the drawings.

DETAILED DESCRIPTION OF THE PREFERRED EMBODIMENTS

Automatic Baler Operation

Figure 1:
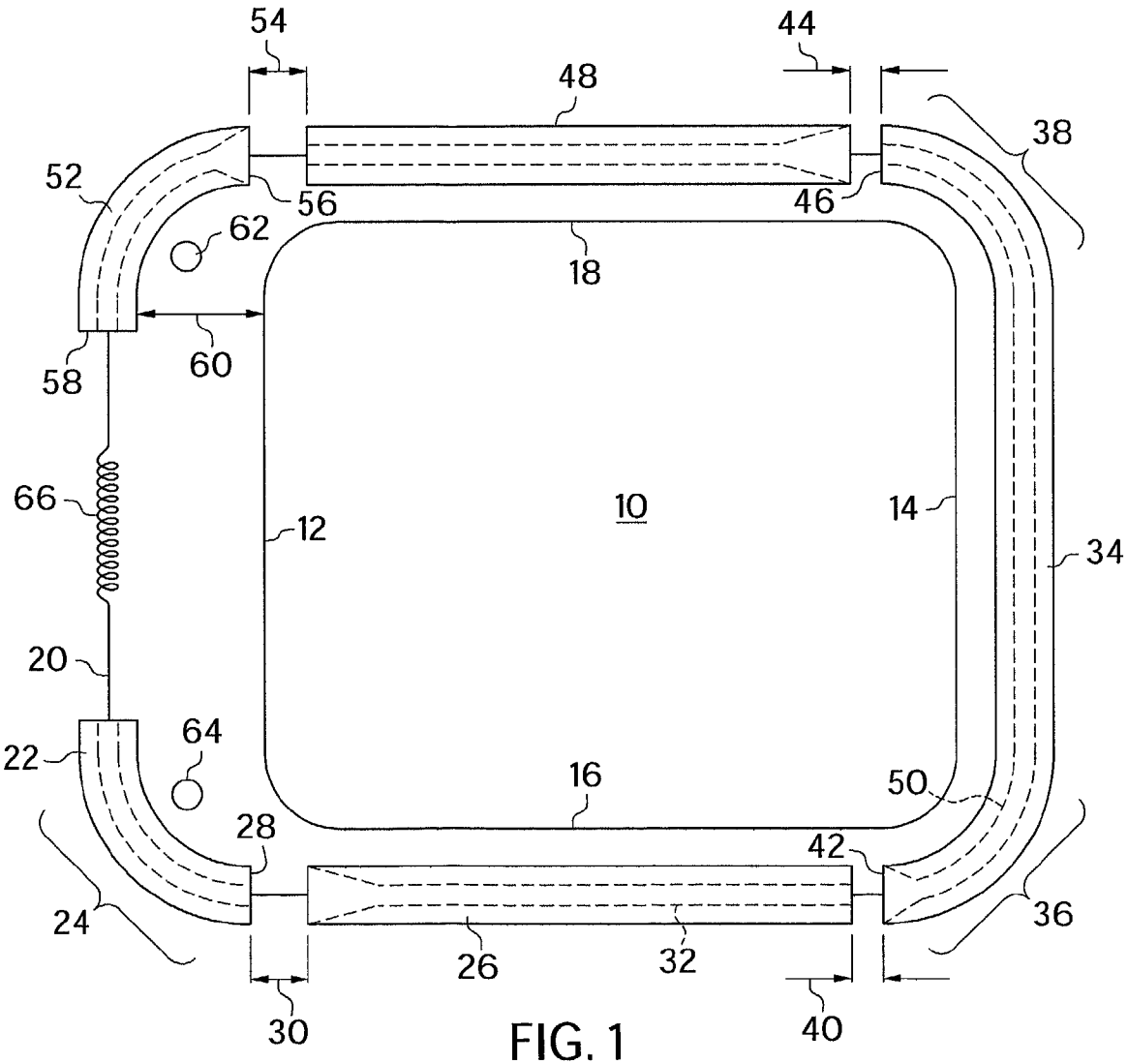
FIG. 1 is a side view of a bale wire guide track.

Referring to the accompanying drawings in which like reference numbers indicate like elements, FIG. 1 is a cross section of a cotton bale under compression, 10, surrounded by a guide track. The cotton bale will have a vertical first side, 12, a vertical opposite side, 14, a bottom side, 16, and a top side, 18. The baling wire, 20, is deployed by the automatic baling machine along a path beginning with wire feeder drive (not depicted) first in a downward direction parallel to the first vertical bale side, 12. The wire path is guided by the wire guide track. The wire feed drive (not shown) propels the wire through a first fixed section of the wire guide track, 22, which redirects the wire progression through curve, 24, to a horizontal path parallel to the bottom of the cotton bale 16. A second straight section of the wire guide track, 26, receives the progressing wire and guides it parallel to the bottom of the cotton bale 16. In the preferred embodiment this second section of the wire guide track is positioned within a channel under a lateral slot of the lower platen (not shown) and moved with the platen. In previous embodiments, the second section had moved with the moveable section of track, and exited the lower platen channels to reach a bale ejection position.

The terminal end of the first fixed wire guide track section, 28, is separated from the initial, wire receiving end of the lower straight wire guide track section, 26, by a gap, 30. Broken lines, 32, within the lower straight wire guide track section indicate the interior track channel and its tapering out to the wide aperture, oriented to receive the progressing wire. A third, moveable section of the wire guide track, 34, receives the wire as it exits the second, straight lower guide track section and redirects the progressing wire along a second curve, 36, and then along straight section, 34, in an upwards vertical direction parallel to the opposing vertical side, 14, of the cotton bale. The third, moveable section of the wire guide track then redirects the progressing baling wire from an upwards vertical direction through curve, 38, to a horizontal direction parallel to the top of the bale, 18. This redirection of the progressing baling wire from an upwards vertical direction to a horizontal direction is achieved by a second curved section, 38, of the third moveable wire guide track section, 34. There is a gap, 40, between the second, straight wire guide track section, 26, and the third wire guide track section, 34, receiving aperture, 42. There is another gap, 44, between the terminal end of the third wire guide track section, 46, and a fourth wire guide track section, 48. The broken lines, 50, illustrate the wide aperture of the third wire guide track section.

The entire third wire guide track section is mounted on a strut assembly (not depicted here) which pivots in order to rotate the strut assembly and third wire track section away from the cotton bale after binding to allow the bale to be expelled. The different positions of the third wire guide track section and strut assembly are depicted and described in relation to FIG. 4 below. The fourth wire guide track section, 48, is straight, about equivalent in length to the width of the cotton bale and parallel to the top of the cotton bale, 18. The fourth wire guide track section is inserted in a channel under the lateral slots of the upper platen (not depicted). The progressing wire exits the fourth guide track section, 48, and is then received by an upper curved portion of the first fixed wire guide track section, 52, which receives the wire from the fourth straight, top wire guide track section, 48, through gap, 54, and into wide aperture, 56, (broken lines) and then redirects the wire in a downward vertical direction parallel with the cotton bales' first side, 12. The wire then exits the terminal end of the upper curved portion, 58, of the first fixed wire guide track section into a fastening header (not depicted).

After the wire loop circuit is complete, tension is placed upon the wire, drawing it out of the wire guide track and into contact with the bale. A space, 60, exists between the knot and the first vertical side of the bale, 12. Tensioning pins, 62 and 64, are actuated by solenoids (not shown) to extend into the plane of the bale wire loop. Upon release of the wire by the guide track, the wire is drawn tight against the bale and the tensioning pins. The pins prevent sharp bends in the wire, and maintain the proper length of the wire.

The fastener automatically ties the leading end of the wire to the terminal end of the wire at knot, 66. After the ends of the wire have been knotted, the tensioning pins, 62 and 64, retract, the pressure on the cotton bale is released, and the consequent expansion of the bale draws the baling wire, 20, tight, eliminating space, 60. This description is illustrative and not limiting. The present invention may also be incorporated in balers with one, two, three or more guide track sections.

Figure 2:
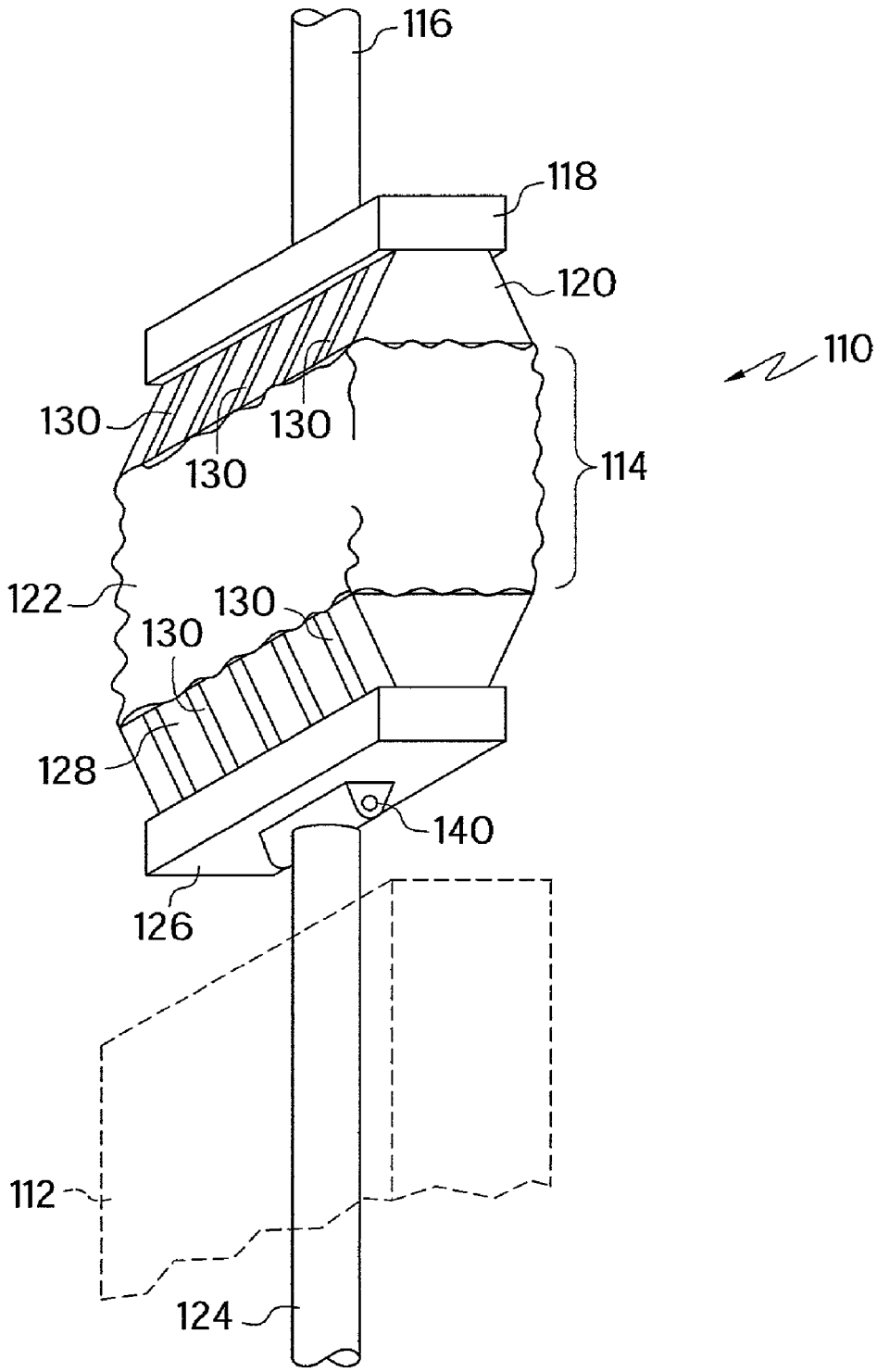
FIG. 2 is an oblique view of the cotton bale compression apparatus, illustrating platens in position for use.

FIG. 2 illustrates the cotton bale compression apparatus, 110. Bulk fibrous material operations, such as cotton gins, typically compress material in a vertical direction. The bulk fibrous material is first restrained from horizontal expansion within a compartment or "box," 112, shown by broken lines. This process forms a predetermined volume and/or weight of material into a rectangular form in a compression area either above or below the baling area. The formed but unbound bale of material is then moved to a baling station, 114, which movement is typically vertical. It is intended that all matter contained in this description and these illustrations shall be interpreted as illustrative rather than limiting. Thus, although typical fibrous bulk material compression operations are vertically aligned, with automatic balers being designed to work in conjunction with such configurations, the breadth and scope of the present invention should not be limited to only vertical compression systems, but would apply equally as well to horizontal or other directions of compression for fibrous bulk materials or other bulk materials.

FIG. 2 depicts a fixed upper shaft, 116, maintaining the position of an upper following block, 118, to which is attached an upper platen, 120. The upper platen arrests the upper progress of a bale of material, 122, and holds it during compression. A lower compression piston, 124, drives in an upward direction from the rectangular compression compartment a lower following block, 126, to which is attached a lower platen, 128, upon which rides the rectangular shaped, predetermined weight or volume of fibrous material, 122. The fibrous material, having been compressed once already in the compression compartment will, upon admission to the bale forming station (depicted below in FIG. 4) expand at first. The lower piston drives the fibrous material rectangle against the upper platen, 120, whereupon the material is compressed a second time into predetermined dimensions. When the predetermined dimensions are reached, the lower compression piston stops and the following blocks and platens hold the compressed bale of fibrous material in position for the automatic baler machine to wrap the wire around the bale and tie the wire.

Lateral slots in the platens, (not shown), allow for release of baling wire from a guide track to contact the bale. Lateral channels, 130 aligned with and behind the lateral slots allow insertion of wire guide track sections. In the preferred embodiment the guide track sections inserted into the lateral channels in the upper following block platen, 120, would be the fourth independent segments of the guide track. Likewise, the lateral slots, (not shown), of the lower platen, 128, allow for release of baling wire from the wire guide track to contact the bale. The wire guide track sections inserted below the lateral slots of the lower platen are the second independent section of the wire guide track.

Figure 3:
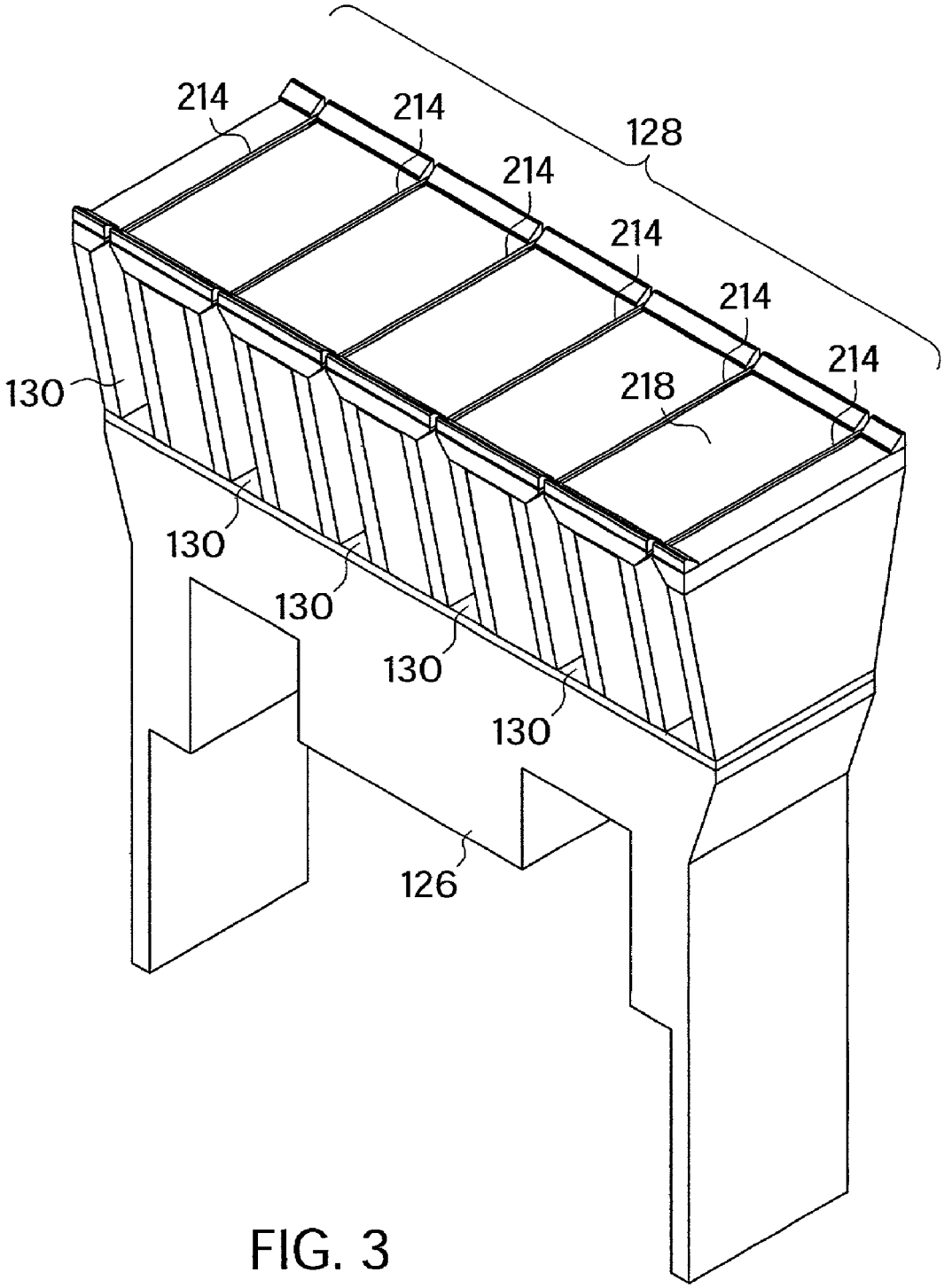
FIG. 3 is an oblique view of a following block and platen.

FIG. 3 is an oblique view of a following block, 126, and platen, 128, showing in greater detail the structure of the lateral slots, 214, and channels, 130. FIG. 3 illustrates the lateral channels' structure designed to receive the wire guide track. FIG. 3 also depicts the platen faces, 218, which come into contact with the compressed bulk fibrous material. On the platen faces can be seen the lateral slots, 214, through which the baling wire passes upon being released by the wire guide track (not depicted) inserted in the channels.

Figure 4:
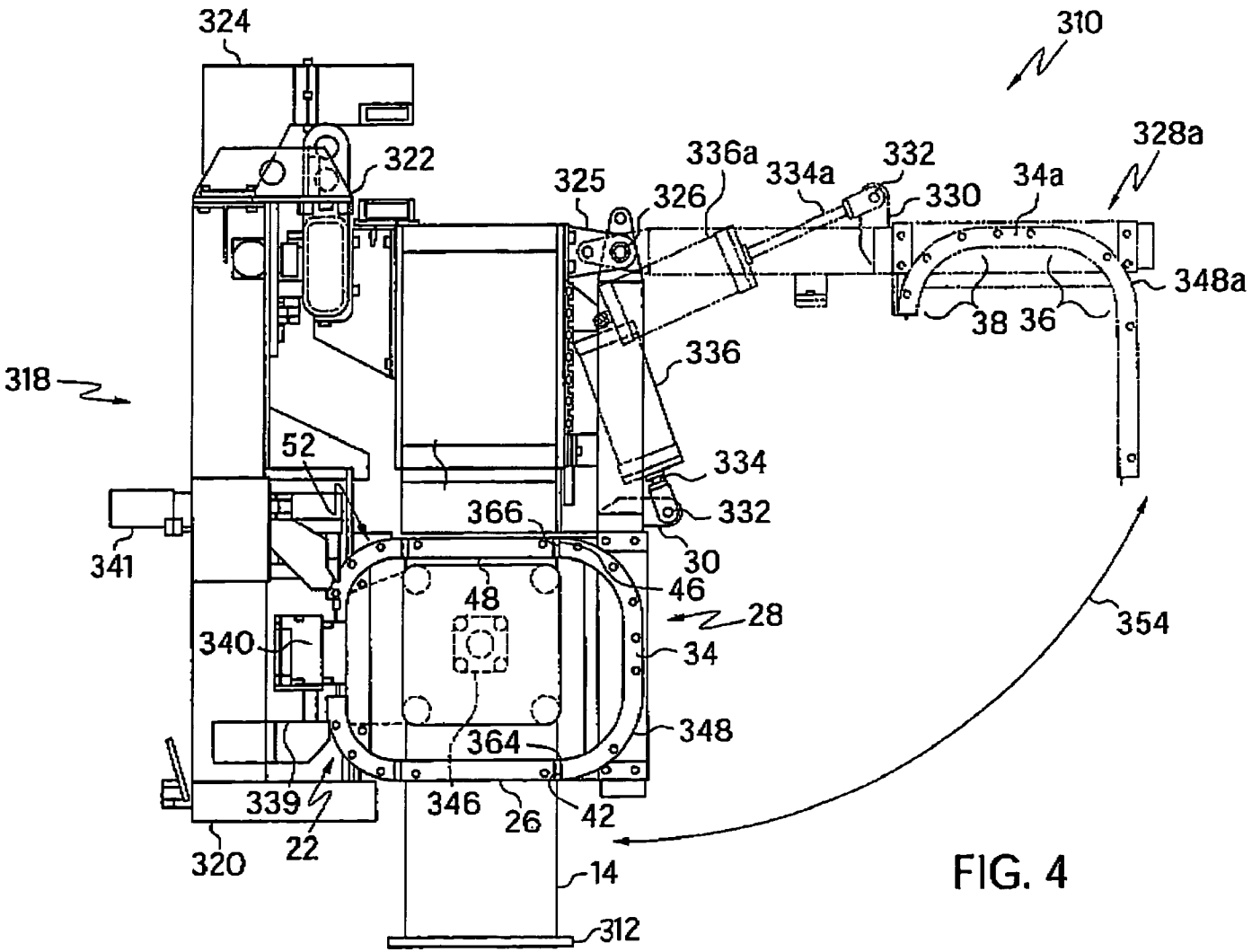
FIG. 4 is a side view of the automatic baling machine.

FIG. 4 illustrates a side view of an embodiment of an automatic baler, whether incorporating the present invention or not. The bale forming and binding apparatus, 310, has two positions; the solid lines illustrate a first position wherein a moveable wire guide track section support strut assembly, 348, completes the wire guide track trajectory when the binding operation is occurring; and the broken lines illustrate a second position wherein the moveable wire guide track support strut assembly is in a second position, **348*a*. The second position allows ejection of the bale from the bale forming station, 346**.

A floor plate, 312, supports vertical support stands, 314, on either side of the bale-forming and binding station, 346. A binding assembly carriage, 318, is borne by stands, 314. The base extension, 320 of the carriage, 318, carries the fixed tying heads, 340, and attached fixed first section of the wire guide track, 22.

Typically bulk fibrous material bales are bound with six baling wires. The depicted embodiment of a prior art baler has three wire guide tracks. In the depicted embodiment, the carriage, 318, translates in a direction perpendicular to the plane of the drawing along an overhead track, 322, attached to the upper rear extent of the stands, 314, whose motion is controlled by drive, 324. The carriage translates in order that the three wire guide tracks may bind an individual bale six times by tying a first set of three wires, then translating, and tying a second set of three wires. The present invention is preferredly embodied in a carriage containing six wire guide tracks, which does not require translation for baling standard density bales, as is depicted and described below. However, the most preferred embodiment will still have a moveable carriage so that more than six wires may be used, so that operation may continue when one head is broken, and so that the carriage can be moved for repair and maintenance.

Extending from the upper forward extent of the stands, 314, are a pair of pivot axis brackets, 325, holding the pivot axes, 326, which carry the moveable guide tracks support strut assembly, 328. Extending forward from the center of the strut assembly, 328, is a member, 330, pivotally connected at pin, 332, to piston arm, 334, which is extended and withdrawn by action of the piston, 336. The action of the piston, 336-336*a*, may be by any means but is preferably pneumatic. The binding wire entering the apparatus, 310, from the wire supply (not shown) at the wire feed drive, 341, is directed by guide track sections 22, 26, 34, 48 and 52, from and to the fastener head, 340, which fastens the wire into a closed loop, typically with a twist knot. The second wire guide track section, 26, lies in the channel within the lower platen (not shown) attached to the lower following block (not shown). The fourth wire guide track section 48, lies in a channel within the upper platen below the upper following block (not shown).

The lower following block is actuated to compress the bulk material (not shown) by compression piston (124 in FIG. 2). The third, moveable wire guide track section, 34, is fixed to the moveable wire guide track section support strut, 328. The positions 328*a*, 34*a* show the parts, 328, 34, at their respective positions when the moveable guide track section is removed from the bale-forming station, 346, for ejection of a bale. The moveable, third guide track section lower entry end, 42, and second guide track section terminus, 364, face one another in near cooperation when the moveable guide track section is lowered for operation. The upper fourth guide track section entry end, 366, and moveable third guide track section terminus, 46, face one another in near cooperation, to complete the wire guide track circuit when the wire guide track support strut, 328, is in the first position for baling. The arctuate line, 354, illustrates the path of motion of the lower terminus of the third moveable guide track section as it transits between positions.

Figure 5:
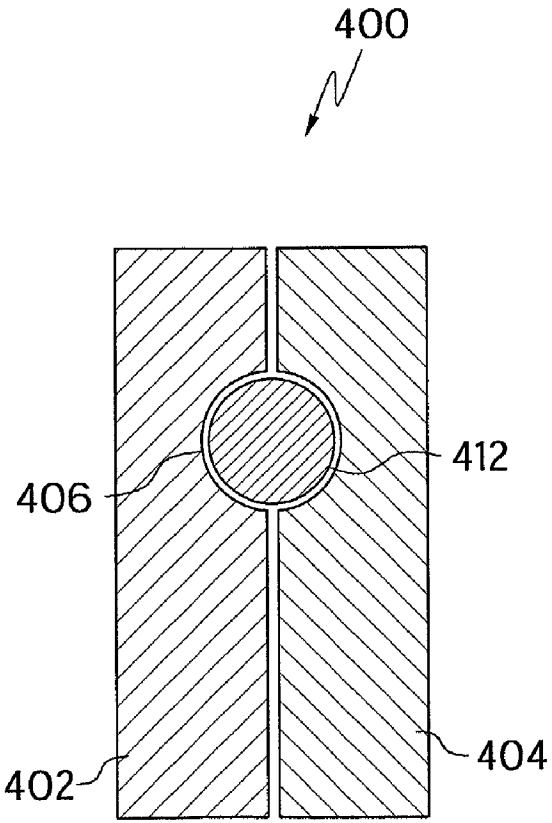
FIG. 5 is an end view of a closed guide track.

FIG. 5 depicts a cross sectional view of the wire guide track construction, 400, in a closed state for the directing of the wire, 412, about the bale. The first longitudinal half, 402, and second longitudinal half of the track, 404, are separable, and are shown as closed, thereby forming a channel, 406.

Figure 6:
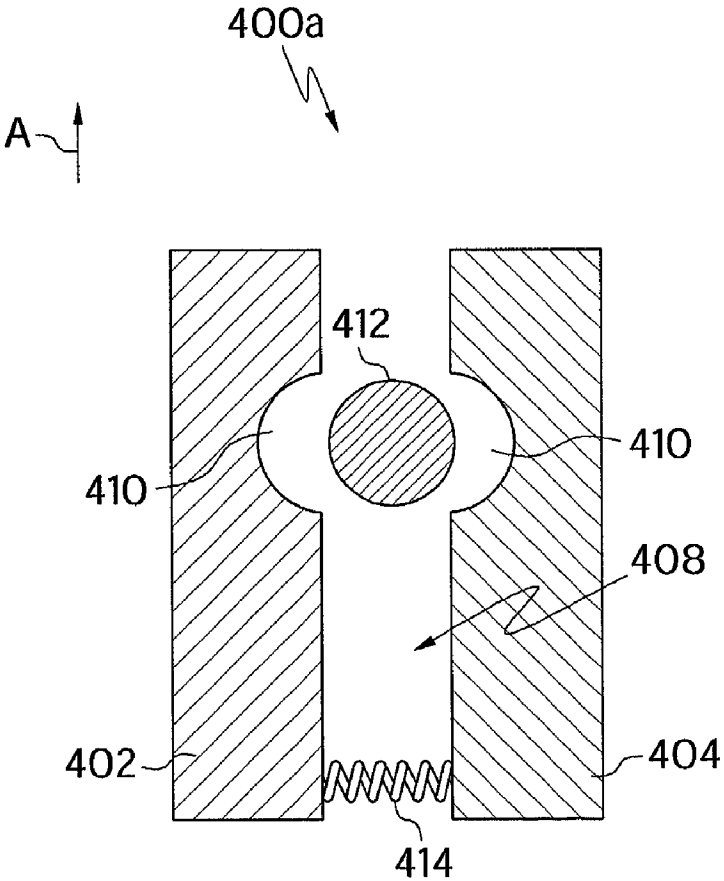
FIG. 6 is an end view of an open guide track.

FIG. 6 depicts a cross sectional view of the wire guide track construction, 400*a*, in an open state for releasing a closed loop of the wire, 412, in the direction shown by the arrow, A towards the compressed bale (not depicted) from between the halves, 402, and 404, now separated to release the wire through the open separation, 408, between them. Grooves, 410, combine to form the two sides of the channel, 406, when in the closed position. Spring means, 414, mediate the transition of the track between the closed and open positions.

In operation as depicted in FIG. 4, when the movable wire guide track support strut assembly, 328, is down, the binding wire enters the apparatus from the wire supply (not shown) at the wire feed drive, 341, and enters the fastener head 340. Drive wheels rotate to push wire frictionally through the fastening head, 340, downwards to the first guide track section, 22, and across, up, back and then down the other guide track sections, 26, 34, 48 and 52, and then back into fastening head, 340, until the end of the wire actuates a limit switch (not shown). In a preferred embodiment, electo-servo motors track the progress of the baling wire and signal completion of the loop to a relay or control circuit, instead of a limit switch. The wire thus forms a loop section with an overlapping wire portion location within fastening head, 340. It is preferred to use #10 gauge wire that is sold by U.S. Wire under the trade name ULTRA STRAP GALVANIZED.

At this point, tensioning pins, 62 and 64, FIG. 1, are extended. The tying head twists the wire into a knot. In order to effect tying, tension is placed on the wire by reversing the drive wheels. This tension pulls the wire out from between the two halves, 402 and 404, of the wire guide track as shown by the releasing action in FIGS. 5 and 6. As the wire is tensioned and breaks out of the channel, 406, and through gap 408, the wire is pulled around the bale and also around tensioning pins, 62, and 64, respectively. These prevent sharp bends in the wire, and insure that the wire circumference is the proper length.

Once the tying head has completed the twist knot, tensioning pins, 62 and 64, are retracted by a solenoid (not shown) until they are out of contact with the wire.

Then, in some embodiments, carriage, 318, FIG. 4, translates to a second index position along overhead track, 322. Wire is again drawn by feed drive (not shown) within fastener head, 340, to push the wire in a loop through all four guide track sections and back into the fastener head, 340. Then the twist knot process repeats.

For cotton bales, six baling wires are used to bind a 500 pound standard density bale of cotton. Thus, if three indexing heads are mounted to carriage, 318, the carriage, 318, must index between a first position and a second position to provide six baling wires. A point of novelty and utility of the present invention is that this step may be eliminated. Carriage translation to a second position is unnecessary with six narrow heads in place. Preferred embodiments with six heads, six wire guide tracks and six tying heads obviate the need for the carriage to translate. Thus cycle time is decreased, and production rates are increased. In three head configurations, the present invention is still useful for its compactness and efficiency.

Figure 7:
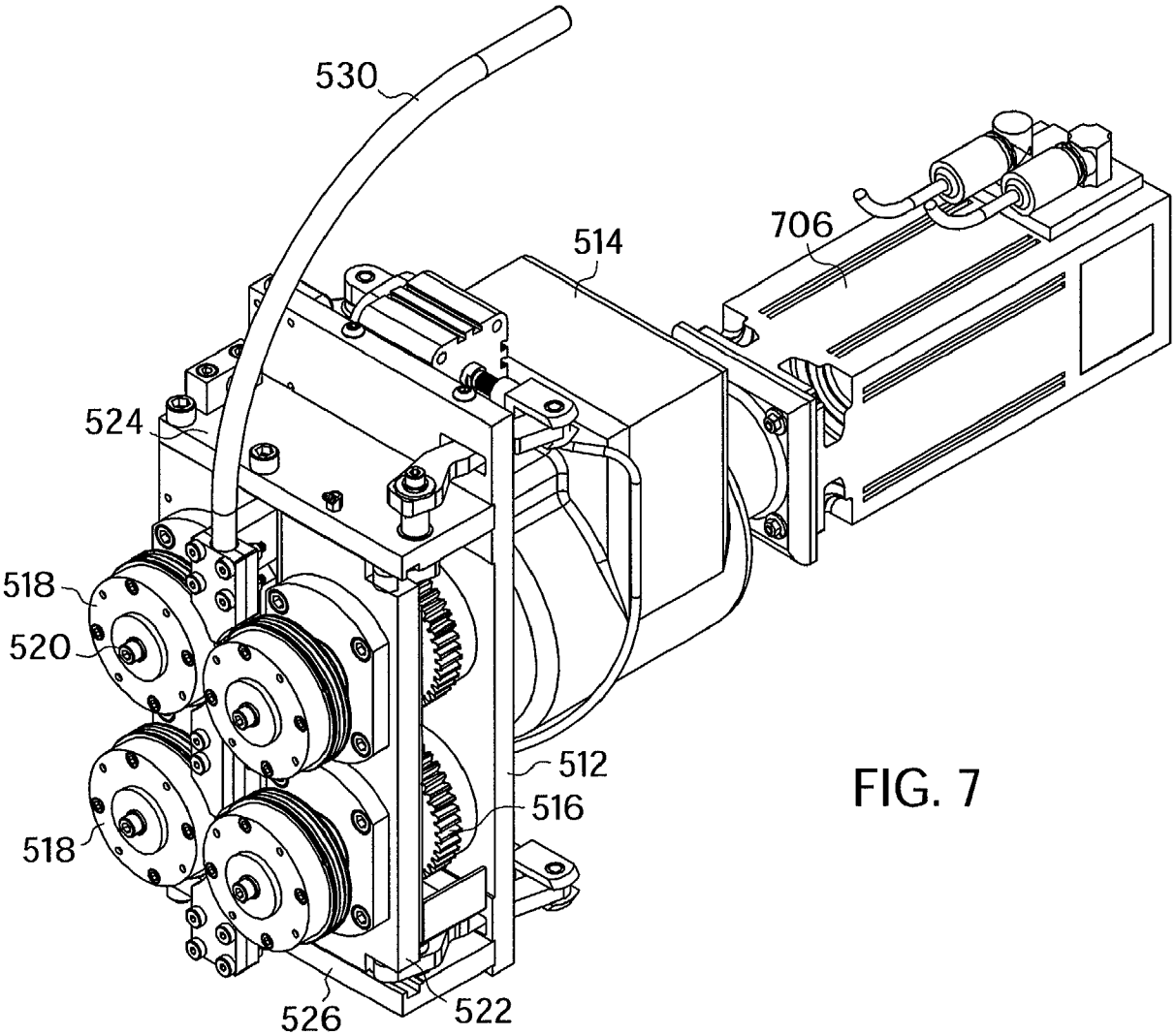
FIG. 7 is an oblique view of a narrow wire feed head.

FIG. 7 is the wire propulsion unit incorporating the preferred embodiment of the present invention. Propulsion electro servo motor, 706, is mounted to mounting bracket, 512, through gear reduction box, 514. A through hole (not shown) in mounting bracket, 512, allows the propulsion electro servo motor drive shaft (not shown) to extend through the mounting plate, 512, to allow its engagement with power train distribution gears, 516. Four power train distribution gears (2 visible) correspond to four frictional drive wheels, 518. Four drive wheel drive shafts, 520, rotatably fix drive wheels, 518, to power train distribution gears, 516, through four through holes in a drive wheel mounting bracket, 522. Mounting bracket, 512, and drive wheel mounting bracket, 522, are fixedly joined by a top horizontal stabilizing plate and a bottom horizontal stabilizing plate, 524 and 526 respectively.

Baling wire (not shown) enters the apparatus through baling wire intake guide, 530. The intake guide directs a progressing baling wire between the drive wheels, 518, where the drive wheels, 518, frictionally propel the progressing baling wire along a pre-determined path. The drive unit is positioned to coordinate in close cooperation with a first section of wire guide track oriented to receive the leading end of the progressing baling wire from the drive wheels, 518.

Figure 8:
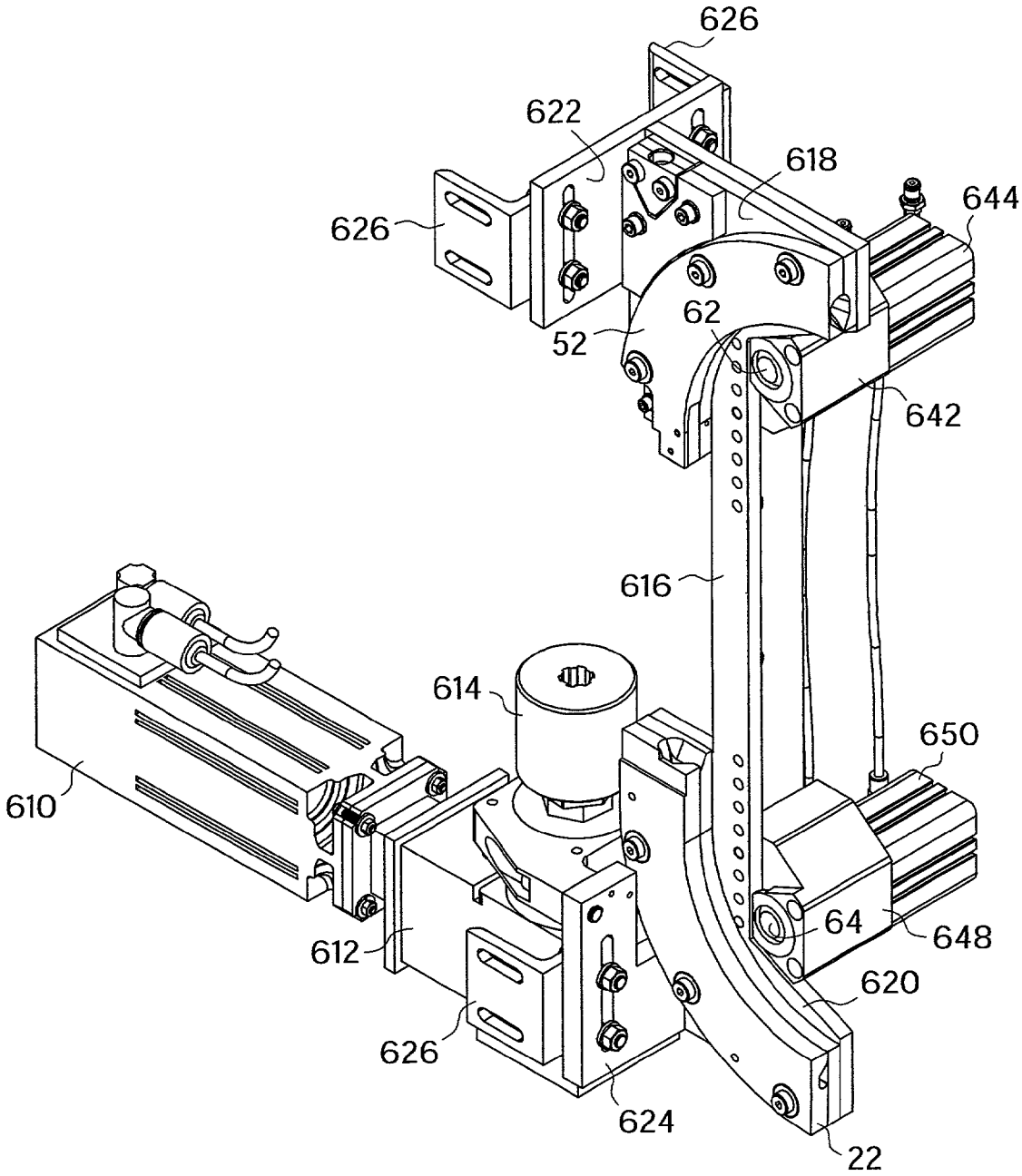
FIG. 8 is an oblique view of head components.

FIG. 8 is an oblique view of some of the components which the narrow head of the present invention must incorporate in addition to the wire feed drive. The head is depicted in FIG. 8 with a tying head electro servo motor, 610, tying head gear box, 612 and lower tying cylinder, 614, mounted on the narrow head.

The narrow head is comprised of the head mounting bracket, 616, upper mounting plate, 618, and lower mounting plate, 620. Onto the upper mounting plate, 618, is further mounted a carriage mounting bracket, 622. Similarly, another carriage mounting bracket, 624, is fixedly attached to the lower mounting plate, 620. Mounting adjustment angle irons, 626, are fixedly attached to the upper and lower mounting brackets.

The fastener unit, comprised of fastener electro servo motor, 610, gear box, 612, lower tying cylinder, 614, and tying station and upper tying cylinder (not shown) are fixedly attached to the narrow head lower mounting bracket, 624.

The first wire guide track section, 22, is mounted to the lower mounting plate, 620. It is oriented with its receiving end upwards, in a position to receive the progressing baling wire lead end from the drive wheels depicted in FIGS. 7 and 9. FIG. 8 does not depict the drive wheels mounted. In alternative embodiments of the present invention, the drive unit, shown in FIG. 7, may be mounted to either the narrow head bracket, 616, or the upper mounting plate, 618, or in any of a variety of configurations, provided that the plane of the drive wheels is not the same as the plane of the baling wire loop. In order to cooperate with the first wire guide track section, 22, the drive unit must be mounted in such a way that the progressing baling wire will enter the receiving end of the first guide track section, 22. Provided mounting is consistent with these two constraints, any means or orientation of mounting the drive propulsion unit that will maintain 9 and ¼ width of the head is within the scope of the present invention.

Finally, it can be seen that the last wire guide track section, 52, is also mounted at the upper mounting plate, 618. Upper tensioning pin, 62, upper tensioning pin mount, 642, and upper tensioning pin solenoid, 644, are also fixedly attached to the upper mounting plate, 618. Likewise, lower tensioning pin, 64, lower tensioning pin mount, 648, and lower tensioning pin solenoid, 650, are all mounted to the lower mounting plate, 620.

The present invention orients the plane of drive wheel pairs 518 perpendicular to the plane of the bale wire loop. The drive wheel servo motor 706 has a length that is greater than the useful 9¼" dimension for the width of the head. Prior art automatic baling machine heads oriented the drive wheels in the same plane as the bale wire loop, necessitating an orientation of the servo motor perpendicular to the plane of the bale wire loop, which occupied too much space to allow the narrow head dimension of the present invention. The present invention configures the problematic long dimension of the servo motor outwards from the head whereby it allows for the head to contain all the necessary components within the useful 9¼ inch width. This is achieved by orienting the drive wheels in a plane perpendicular to the plane of the bale loop.

Figure 9:
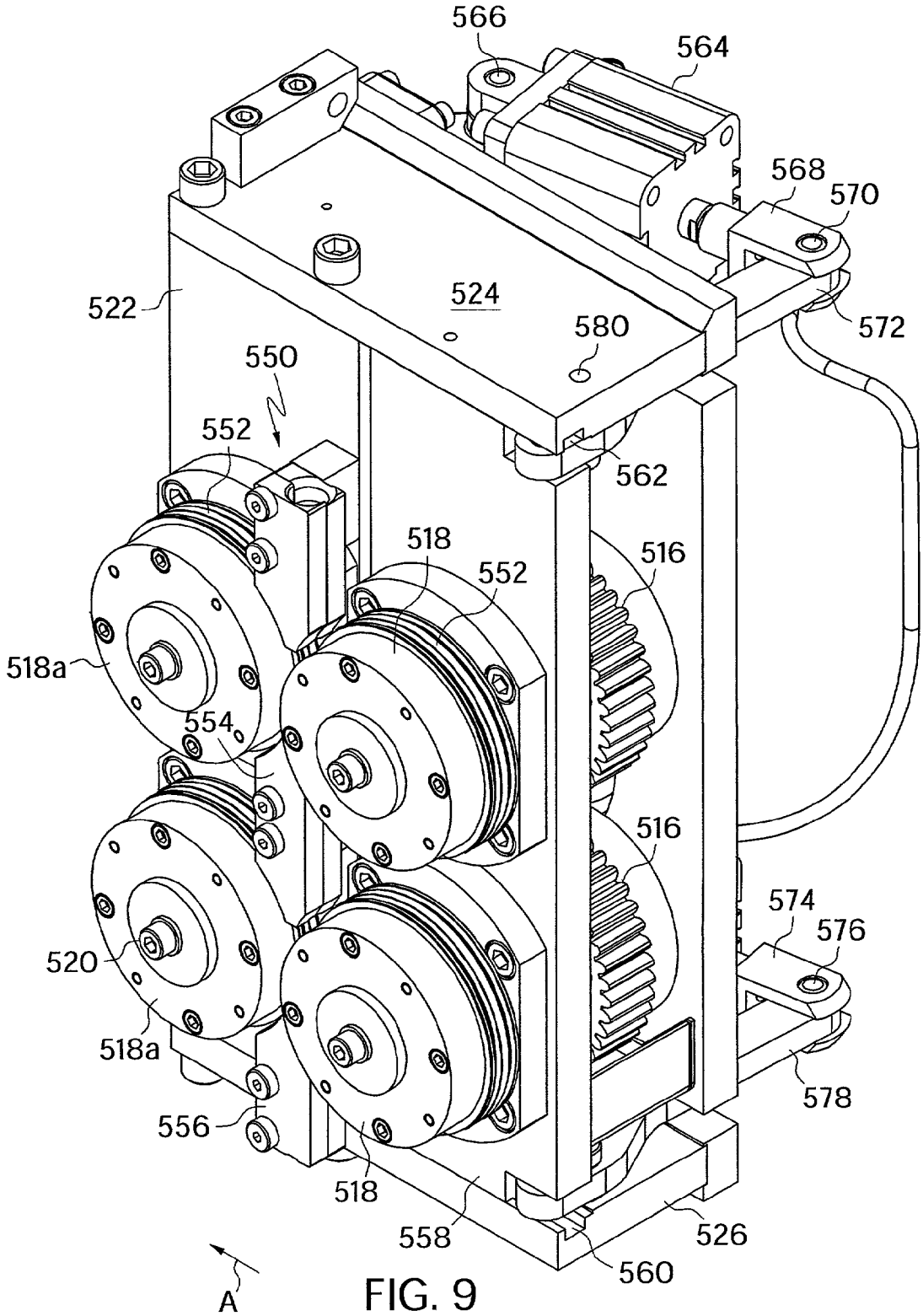
FIG. 9 is an oblique view of a drive wheel assembly.

FIG. 9 is a closer view of the wire feed drive of the present invention. This view shows more closely the drive wheel pressure control apparatus. Wire propulsion and reverse tensioning are frictional. Incoming wire enters the wire feed drive unit at wire guide orifice, 550. The guide directs the baling wire between the first and second pairs of wire drive wheels, 518 and 518(*a*). Wire friction surfaces, 552, contact the wire between gaps in wire guide sections 550, 554 and 556. Frictional pressure is exerted on the wire by the apparatus depicted in this figure. Left hand drive wheels, 518(*a*) are held stationary by front mounting plate, 522, which is fixed to upper and lower mounting plates, 524 and 526. Right hand drive wheels, 518, are fixedly attached to slideable front mounting plate, 558. Slideable mounting plate, 558, may be moved along the plane of the drive wheels, 518, towards the wire for greater pressure, or away from the wire for reduced pressure. Arrow (A) indicates the direction of greater pressure. Slideable front mounting plate, 558, slides laterally in channels, 562, and 560 in the upper and lower mounting plates, 524 and 526 respectively. The sliding drive is powered by solenoid, 564. Solenoid, 564, is pivotally mounted at its rear at pivoting axis, 566. Solenoid pin, 568, is pivotally mounted at axis pin, 570, to lever, 572. A lower solenoid (obscured) is similarly mounted with a lower drive pin, 574, pivot axis, 576, and lever, 578. Levers, 572 and 578 are pivotally mounted at a fulcrum axis, 580, for the upper lever, 572, and an obscured fulcrum pivot axis for lower lever, 578. Levers, 572 and 578 are pivotally mounted to slideable front mounting bracket, 558, at pivot axes which are obscured in this figure.

In operation, upper solenoid, 564, and lower solenoid drive solenoid pins, 568 and 574 outward, causing a corresponding inward motion in direction (A) of slideable front mounting plate, 558, which increases the pressure of drive wheel pressure surfaces, 552, on the baling wire progressing through and between guide tracks, 550, 554 and 556. In this fashion a constant, proper degree of pressure is exerted by the wire feed drive of the present invention if different gauges of wire with different diameters are used, or if wear on drive wheel pressure surfaces, 552 changes their diameter over time. It is another point of novelty of the present invention that this configuration is compact enough to fit within the 9¼ inches of width which contributes to the utility of the present invention.

Figure 10:
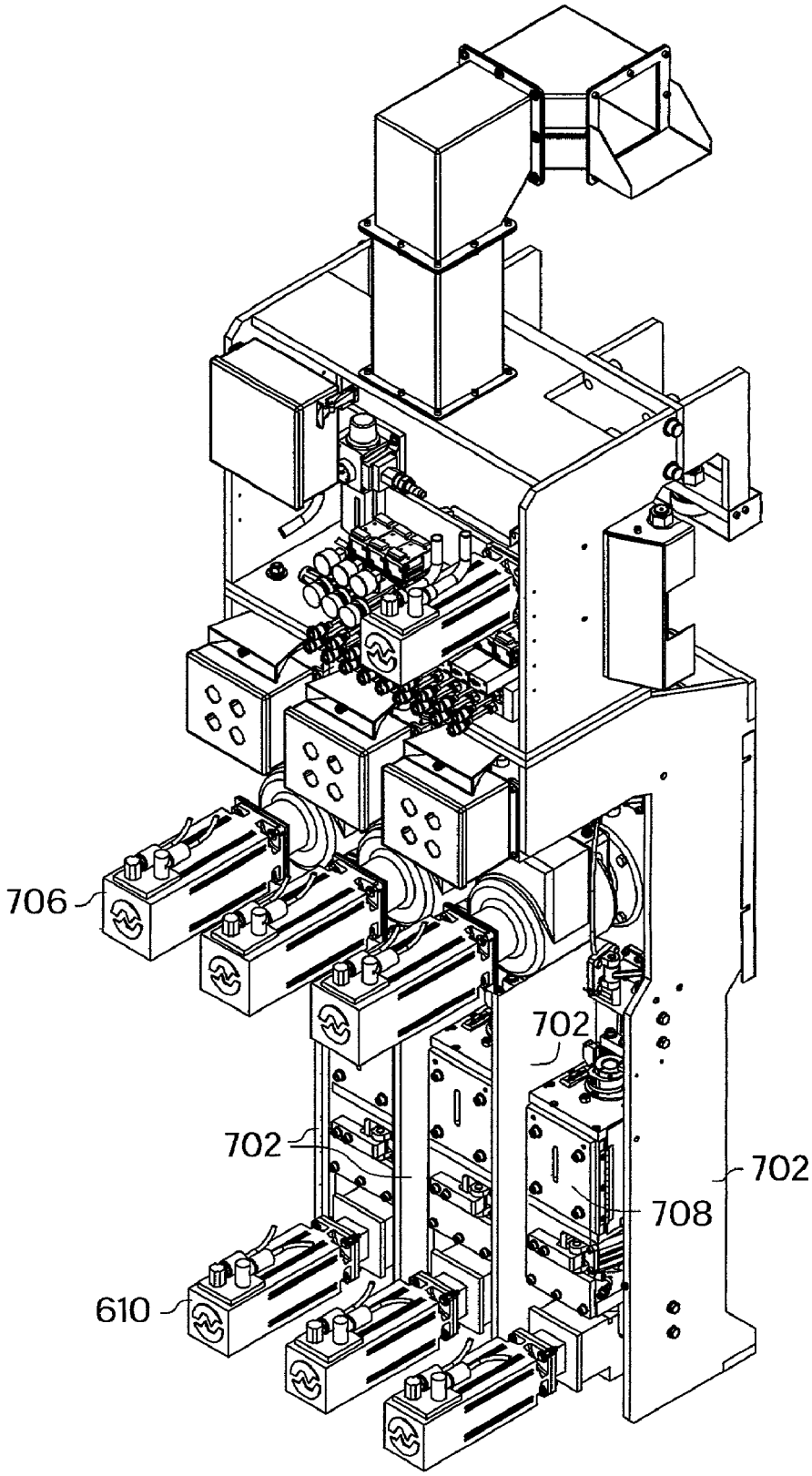
FIG. 10 is an oblique view of a narrow head configuration.
Figure 11:
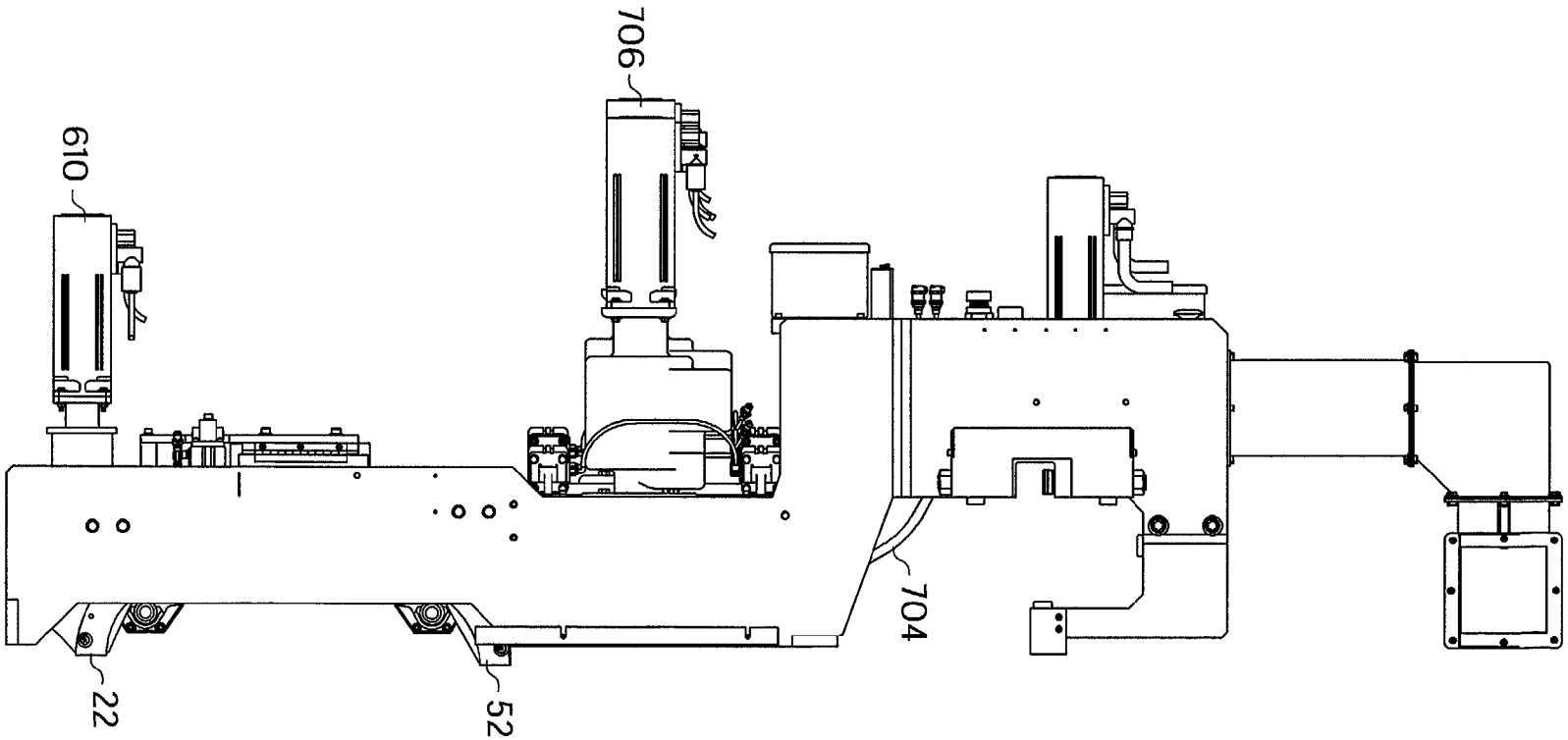
FIG. 11 is a side view of a narrow head configuration.
Figure 12:
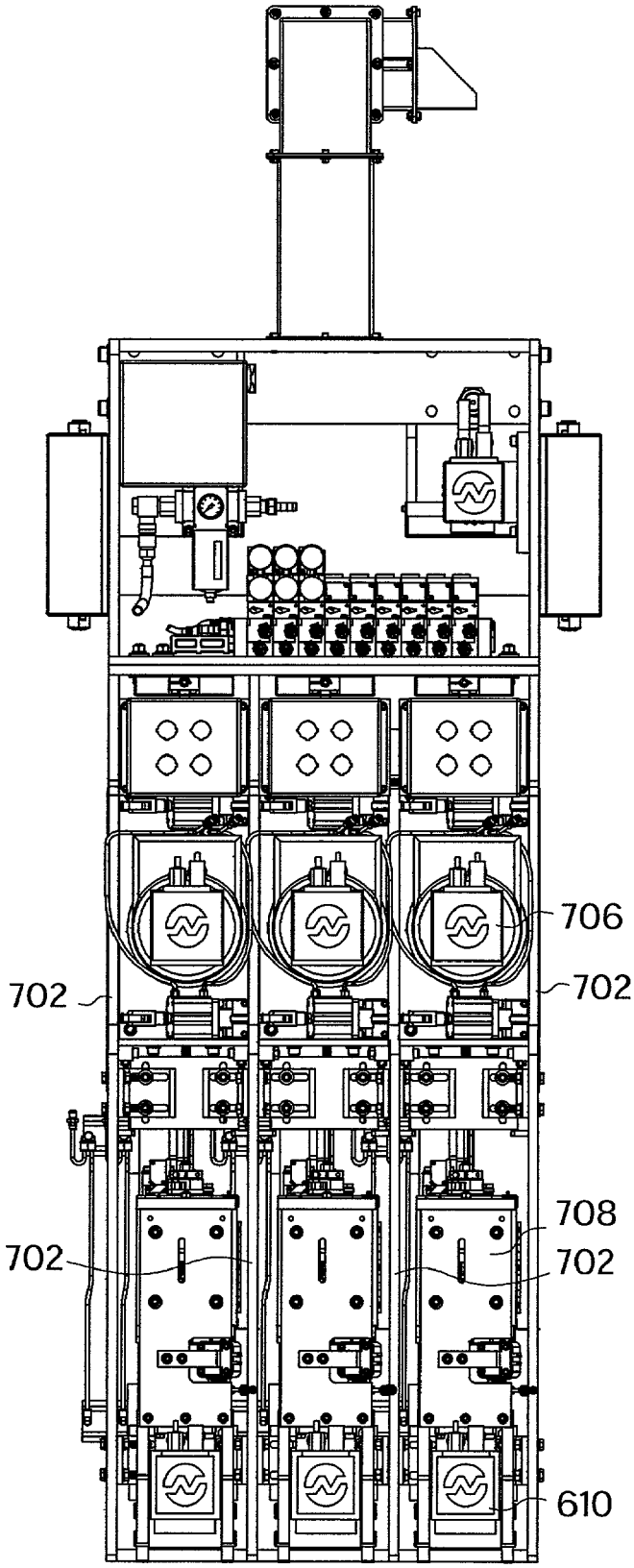
FIG. 12 is a front view of a narrow head configuration.

FIGS. 10, 11 and 12 are oblique, side and front views, respectively, of the present invention's configuration of components within a narrow head dimension. Three heads are depicted. Another preferred embodiment has six heads. Head walls 702 separate the components of a head from those of the adjacent head, and provide a mounting plate for components. Baling wire enters the head from a wire dispensing station (not shown), through guide 704.

The drive wheels direct the progress of the baling wire through the fastening station in front of the fastener 708 and into a channel within a first, fixed section of wire guide track, 22. The first fixed section of wire guide track, 22, redirects the direction of the progressing bale wire from a downwards direction to a horizontal direction corresponding to a receiving end of a horizontal second section of guide track (not shown).

After its circuit through the wire guide track and around the bale, the baling wire re-enters the head at upper fixed wire guide track section 52. The upper curved section of the wire guide track receives the progressing baling wire from an exit end of a horizontal previous section of wire guide track (not shown) and redirects it in a downward direction to enter fastening station 708. The drive wheels' servo motor 706 is signaled to stop either by a limit switch or, in the preferred embodiment, by reaching a terminal position pre-configured in the servo control system memory. A tensioning gripper (not shown) then extends to hold the baling wire in a fixed position.

The two tensioning pins, 62 and 64 extend into the plane of the bale wire loop. After gripping and holding the baling wire, a signal is sent to the drive wheels' servo motor to reverse direction whereupon the drive wheel pairs frictionally tension the baling wire in a direction opposite its original progression around the bale. Tensioning of the wire produces an inward pressure on the wire which is designed to be of sufficient strength to overcome the restraining lateral pressure of the wire guide track longitudinal halves (depicted in FIGS. 5 and 6). Thereby affecting release of the bale wire by the guide track. The wire then comes into contact with the bale and tensioning pins.

Such tensioning is also required for proper operation of the fastener 708. Upon being sufficiently tensioned to exit the wire guide track, the ends of the wire are ready to be tied by the fastener.

The fastener must generate a knot which is compliant with industry standards for knot tension strength. The knot fastener is comprised of a tying servo motor 610 which drives a tying cylinder 614 which rotates a predetermined amount, typically about 360°, and, through a gear reduction box, produces a number of twists in the baling wire ends, typically eight in number. After knotting, the wire is released and its proximal end is cut, both by conventional mechanical means.

The term "strap" is a recognized industry term of art understood by those of skill in the art to mean generically wire, metal bands, plastic bands or other types of straps. The preferred embodiment of the present invention uses "straps" that are wire, most preferedly 10-guage wire. Those of skill in the art will understand from the use of the term "strap" that the scope of the present invention applies equivalently to both wire, metal bands, plastic bands and any other kind of binding strap used in bulk material baling.

In view of the foregoing, it will be seen that the several advantages of the invention are achieved and attained.

The embodiments were chosen and described in order to best explain the principles of the invention and its practical application to thereby enable others skilled in the art to best utilize the invention and various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A bulk material baler comprising:

a frame with a plurality of head walls;

a plurality of bale strap guide tracks deployed on said frame, each spaced substantially about 9 and ¼ inches from adjacent bale strap guide tracks;

a plurality of bale strap drivers, each fixedly attached to one of the plurality of head walls and each driver being driven by an electro-servo motor, and each driver being operatively aligned with one of the bale strap guide tracks, each of said bale strap drivers driving a strap via at least one pair of strap drive wheels by frictional contact with the strap, each pair of strap drive wheels being located in a plane perpendicular to the plane of said bale strap guide tracks, wherein said wheels of the plurality of bale strap drivers drive strap through at least two adjacent strap guide tracks simultaneously; and a plurality of bale strap fasteners, each fixedly attached to one of said head walls and each operatively aligned with one of the bale strap guide tracks.

2. The apparatus of claim 1 wherein the bale strap guide tracks, strap drivers and fasteners are each six in number.

3. A bulk material baler comprising:

a baler base;

a plurality of head walls supported by a translating carriage slideably attached to said base;

a plurality of bale strap guide tracks supported by said head walls and configured to space a plurality bale strap loops substantially about 9 and ¼ inches from adjacent bale strap loops;

a plurality of bale strap drivers supported by said head walls, each operatively aligned with one of said bale strap guide tracks, each of said bale strap drivers driving a strap via at least one pair of strap drive wheels by frictional contact with said strap, each pair of strap drive wheels being in a plane perpendicular to the plane of said bale strap loop and being propelled by a separate electro-servo motor, wherein the plurality of bale strap drivers drive strap through at least two adjacent strap guide tracks simultaneously; and a plurality of bale strap fasteners supported by said head walls and each operatively aligned with one of said bale strap guide tracks.

4. The apparatus at claim 3 wherein each of said bale strap fasteners is propelled by an electro-servo motor.

5. The apparatus of claim 3 wherein said head walls are six in number, each of said heads supporting one bale strap guide track, one bale strap driver and one strap fastener.

6. The apparatus of claim 5 wherein each of said strap fasteners is propelled by an electro-servo motor.

7. The apparatus of claim 3 wherein said carriage assembly has three support heads, each of said heads supporting one bale strap guide track, one bale strap driver and one strap fastener.

8. A bulk material baling apparatus comprising:

a bale forming and binding station; and a bale binding device, said binding device employing strap for binding a bale of bulk material contained within said binding station, said binding device having a support bracket housing a plurality of electro-servo strap propulsion units, a plurality of articulated guide tracks and a plurality of fasteners;

wherein said binding device receiving strap wire through the plurality of strap propulsion units, each of said propulsion units impelling strap via at least one pair of strap drive wheels by frictional contact with the strap, said at least one drive wheel pair being in a plane perpendicular to the plane of said guide tracks, said at least one drive wheel pair being propelled by an electro-servo motor, with said binding device driving strap through a plurality of adjacent articulated guide tracks simultaneously, said articulated guide tracks directing the strap in a trajectory surrounding the bale, said fastener, upon a length of the strap completing a circuit of the surrounding trajectory, fastening the complete circuit length of the strap into a closed loop about the bale; and said support bracket being configured to space each closed loop of bale strap substantially about 9¼ inches apart from adjacent closed loop of bale strap.

9. The apparatus of claim 8 wherein the bale strap guide tracks, strap propulsion units, propulsion electro-servo motors, fasteners and support brackets are each six in number.

10. The apparatus of claim 8 wherein a drive shaft of said electric servo motor is parallel to the plane of the bale strap loop.

11. The apparatus of claim 9 wherein drive shafts of all six of said propulsion units are parallel to the plane of said bale strap loops.

12. The apparatus of claim 8 wherein the drive shaft of said electric servo motor is perpendicular to the plane of the said at least one pair of drive wheels.

13. A device comprising:

a plurality of strap guide tracks located in substantially parallel planes for directing strapping into a loop;

a plurality of strap drivers, each with an electro-servo motor driving at least one pair of wheels for driving strapping by frictional contact; and a plurality of strap fasteners for fastening strapping into a closed loop;

wherein:

the at least one pair of wheels of each driver are located in a plane perpendicular to the plane of the strap guide tracks;

each driver has a corresponding fastener and a corresponding one of the plurality of strap guide tracks operatively connected so that each driver is operatively aligned to feed strapping through the corresponding guide track and into the corresponding fastener.

14. The device of claim 13, wherein the plurality of drivers drive strapping through two or more of the plurality of guide tracks simultaneously.

15. The device of claim 14, wherein the guide tracks are spaced substantially about 9 and ¼ inches apart.

16. The device of claim 15, wherein the strap guide tracks, strap drivers, and strap fasteners each are six in number.

17. The device of claim 15, further comprising a carriage, wherein the plurality of drivers and the plurality of fasteners are affixed to the carriage and the carriage is operable to translate the plurality of drivers and the plurality of fasteners in a direction perpendicular to the plane of the guide tracks.

18. The device of claim 15, wherein each guide track has one corresponding driver and one corresponding fastener.

19. A device comprising:

a plurality of strap guide tracks for directing strapping into a loop;

a plurality of narrow head strap drivers each operatively aligned to drive strapping into a corresponding one of the plurality of strap guide tracks; and a plurality of strap fasteners, each corresponding to one of the plurality of narrow head strap drivers; wherein:

each strap driver is operatively connected to the corresponding strap guide track and the corresponding strap fastener, such that each driver is operatively aligned to feed strapping though the corresponding guide track and into the corresponding fastener; and the plurality of strap drivers arc operable to drive strapping simultaneously though multiple strap guide tracks.

20. The device of claim 19, wherein each narrow head strap driver comprises:

an electro-servo motor; and a plurality of strap drive wheels driven by the motor and located in a plane perpendicular to the plane of the guide tracks.

21. The device of claim 19, further comprising a carriage, wherein the carriage is operable to translate the plurality of narrow head strap drivers and the plurality of strap fasteners in a plane perpendicular to the plane of the plurality of strap guide tracks.

22. The device of claim 19, wherein each narrow head strap driver occupies no more than about 9¼ inches width.

23. The device of claim 19, wherein each narrow head strap driver drives strapping through one of the plurality of strap guide tracks and into the corresponding strap fastener, which fastens the strapping to form a closed loop.

24. The device of claim 19, wherein the strap guide tracks are spaced substantially about 9¼ inches apart.

* * * * *